US007264197B2

(12) United States Patent
Yu

(10) Patent No.: US 7,264,197 B2
(45) Date of Patent: Sep. 4, 2007

(54) PAPER TOWEL HOLDER

(75) Inventor: Kwok Leung Yu, Kwai Chung, New Territories (HK)

(73) Assignee: Ko Fung Products Industrial Limited, Kwai Chung, New Territories, Hong Kong (CN)

( * ) Notice: Subject to any disclaimer, the term of this patent is extended or adjusted under 35 U.S.C. 154(b) by 0 days.

(21) Appl. No.: 11/643,361

(22) Filed: Dec. 21, 2006

(65) Prior Publication Data

US 2007/0176043 A1 Aug. 2, 2007

(30) Foreign Application Priority Data

Dec. 22, 2005 (HK) ..... 05111870
Jul. 3, 2006 (GB) ..... 0613102.3

(51) Int. Cl.
*B65H 75/18* (2006.01)

(52) U.S. Cl. ..... 242/597.7; 242/591; 248/206.2

(58) Field of Classification Search ..... 242/597.7, 242/597.4, 596.8, 597.5, 597.6, 597.8, 591, 242/599.4, 599.3; 248/206.2, 205.5, 205.6, 248/683, 205.8, 363, 309.3; D6/522, 523, D6/512; 206/494, 390, 408, 416
See application file for complete search history.

(56) References Cited

U.S. PATENT DOCUMENTS

| | | | | |
|---|---|---|---|---|
| 4,012,007 | A | 3/1977 | Cunningham | |
| 4,883,282 | A * | 11/1989 | Wolf et al. | |
| 6,193,197 | B1 * | 2/2001 | Lian | 248/206.2 |
| 6,308,923 | B1 * | 10/2001 | Howard | 248/205.5 |
| 6,405,973 | B1 * | 6/2002 | Hollinger | 242/597.7 |
| 6,443,388 | B1 | 9/2002 | Hollinger | 242/597.7 |
| 6,776,368 | B1 * | 8/2004 | Duncan et al. | 242/597.7 |
| 6,832,739 | B1 * | 12/2004 | Kraus | |
| 6,932,306 | B2 * | 8/2005 | Zou et al. | 248/205.5 |
| 6,942,188 | B2 * | 9/2005 | Tsay et al. | 248/205.8 |
| D521,287 | S | 5/2006 | Mellen et al. | D6/521 |
| 2003/0029961 | A1 | 2/2003 | Hollinger | 242/597.7 |

FOREIGN PATENT DOCUMENTS

| | | |
|---|---|---|
| CN | 2389611 Y | 8/2000 |
| CN | 2684737 Y | 3/2005 |
| DE | 299 03 274 U1 | 9/1999 |
| DE | 203 18 497 U1 | 4/2004 |

OTHER PUBLICATIONS

Great Britain Search Report for Serial No. GB0613102.3 dated Sep. 12, 2006.
Great Britain Search Report for Serial No. GB0603250.2 dated May 11, 2006.
Hong Kong Search Report for Serial No. HK1081054 dated Jan. 16, 2006.
Co-pending U.S. Appl. No. 29/262,614, filed Jul. 7, 2006.

* cited by examiner

*Primary Examiner*—William A. Rivera
(74) *Attorney, Agent, or Firm*—McCormick, Paulding & Huber LLP

(57) ABSTRACT

A paper towel holder comprising a base and a mandrel extending upwardly from the base, the base including a suction cup arranged to engage a support surface in use, an actuator mechanism adapted to raise or lower the centre of the suction cup to create or release a movement resisting suction between the cup and a support surface, the mechanism comprising an elongate member connected to the cup and extending axially of the mandrel, an actuator including a hand grip mounted for rotational movement at the top of the mandrel, one or more radially extending projections at the top of the elongate member, the actuator including a collar comprising one or more of cam surfaces, the or each cam surface being arranged to engage the or each projection to raise or lower the said projection as the actuator is rotated, a sleeve including one or more of vertical guide channels, each channel being adapted to receive a projection to prevent rotation of the projection during use.

14 Claims, 5 Drawing Sheets

PAPER TOWEL HOLDER

CROSS REFERENCE TO RELATED APPLICATIONS

Applicant hereby claims foreign priority benefits under U.S.C. § 119 from Hong Kong Patent Application No. 05111870.7 filed on Dec. 22, 2005 and Great Britain Patent Application No. 0613102.3 filed Jul. 3, 2006, the contents of which are incorporated by reference herein.

FIELD OF THE INVENTION

This invention relates to a holder for a roll of paper, particularly but not exclusively for a roll of paper arranged so that a single or multiple sheets may be dispensed in use. Such rolls find particular application as kitchen towels or for other domestic purposes wherein it is convenient for the sheets to be dispensed while the roll is in from a vertical orientation.

BACKGROUND OF THE INVENTION

U.S. Pat. No. 4,012,007 discloses a paper towel holder having a suction cup for attachment to a worktop and a vertically extending standard so that a roll can be held in an upright position. The diameter of the standard is selected to closely engage the interior of the roll to limit but not prevent rotation of the roll during dispensing. This facilitates a single-handed operation. A mechanism is provided to move the centre of the suction cup away from and toward the supporting surface to create or release a vacuum to secure the holder to the work surface or to release the holder from the work surface. The mechanism comprises a cam at the top of the standard connected to the cup by a centrally disposed linkage.

SUMMARY OF THE INVENTION

According to the present invention a paper towel roll holder comprises:

a base and a mandrel extending upwardly from the base, the base including a suction cup arranged to engage a support surface in use, an actuator mechanism adapted to raise or lower the centre of the suction cup to create or release a movement resisting suction between the cup and a support surface, the mechanism comprising an elongate member connected to the cup and extending axially of the mandrel, an actuator including a hand grip mounted for rotational movement at the top of the mandrel, one or more of radially extending projections at the top of the elongate member, the actuator including a collar comprising one or more of cam surfaces, the or each cam surface being arranged to engage a said projection to raise or lower the said projection as the actuator is rotated, a sleeve including one or more of vertical guide channels, the or each channel being adapted to receive a projection to prevent rotation of the projection during use.

In a preferred embodiment there are two or more projections and corresponding cam surfaces. The projections may be integral to form a T shaped member located upon the end of the elongate member.

A holder in accordance with the present invention has the advantage of a reliable and durable operation in use.

The elongate member may comprise an inextensible member for example a rod, strip, cord or chain. In a preferred embodiment the elongate member comprises a rod which may be preferably rectangular or square in cross section. Any alternative inflexible or rigid elongate member may be employed. Use of a rigid elongate member is advantageous as this arrangement allows responsive actuation upon rotation of the handle.

In a preferred embodiment a spring is located between the cup and the base and adapted to urge the raised portion of the cup downwardly when the mechanism is lowered. In this way sticking of the cup is avoided.

The mandrel may be tubular and particularly cylindrical or any other convenient cross sectional shape.

The sleeve may be generally cylindrical and adapted to be located within the mandrel. In a preferred embodiment the exterior of the sleeve is ribbed or otherwise formed to permit secure engagement within the mandrel. In a preferred embodiment the sleeve includes a rectangular or square collar to constrain a similarly shaped rod preventing rotation of the rod during use so that the rod is limited to sliding movement with the sleeve.

The actuator preferably comprises a hand grip and a downwardly extending cylindrical collar. The diameter of the collar may be selected to permit rotation within the sleeve.

Preferably two diametrically opposed radially extending projections are employed. The collar may have two corresponding slots adapted to receive the projections.

The slots may each have a downwardly extending mouth and a sinusoidal or inclined portion so that the projections are raised as the handle is rotated.

Preferably, the upper end of each slot has a downwardly extending end portion or rebate dimensional to receive a projection to hold the projection in the raised position.

The slot is preferably arranged to raise the projection as the handle is rotated through 90°. The end portion may be adapted to receive and hold the projection in the uppermost position of the actuating mechanism against the downward force of the spring. The slot is preferably arranged so that the projection may be released in an over centre manner as the handle is rotated in the release direction.

In a preferred embodiment the handle is rotated clockwise to raise the actuator and anticlockwise to lower the actuator. This facilitates convenient use by a right-handed person.

It is advantageous that the handle does not rise or fall during rotation. This is preferred so that the weight of a user's hand does not impede the rotation of the handle in use.

In a preferred embodiment an engagement pad is located on an arm extending upwardly from an outer part of the base, the arm being arranged to be resiliently deflected outwardly as the rod is inserted and biased radially inwardly against the roll to exert a rotation impeding force on the roll. In this way the arrangement allows sheets to be torn from the roll without need to use both hands. This arrangement is convenient since a roll of any diameter may be used irrespective of the size of the mandrel. The pad may have a friction-creating surface, for example a rubber-coated surface, to increase engagement with the sheets on the roll.

The handle or hand grip is preferably removable to permit replacement of the roll. This avoids the need for use of a small dimensioned handle that can be inserted through the core aperture of the roll. Use of a larger handle is convenient particularly allowing use by elderly or less dexterous persons who might not be able to actuate a small sized handle.

BRIEF DESCRIPTION OF THE DRAWINGS

The invention is further described by means of example but not in any limitative sense with reference to the accompany drawings of which

DETAILED DESCRIPTION OF THE INVENTION

Figure 1:
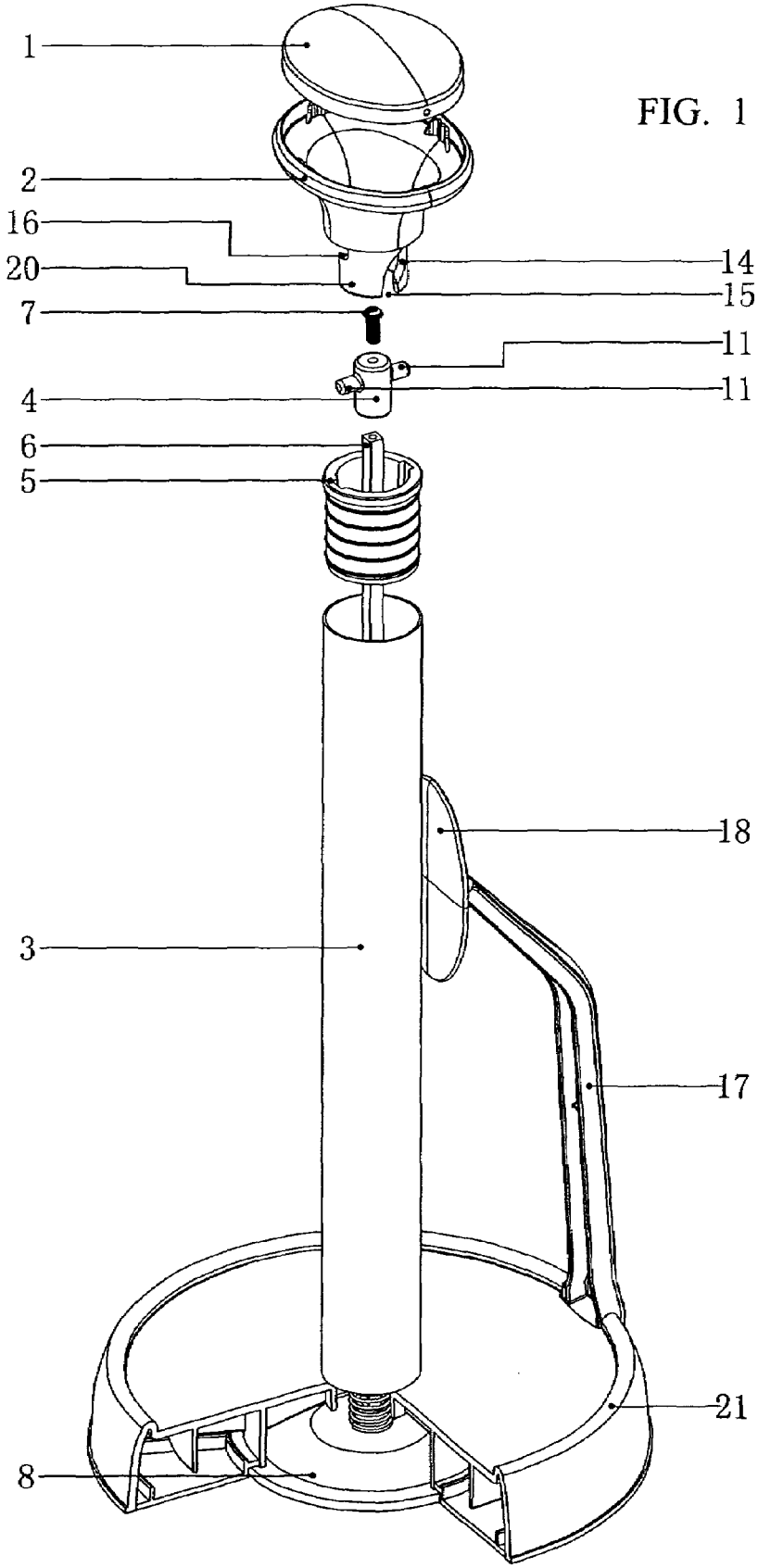
FIG. 1 is a partially cut away and exploded view of a paper towel holder in accordance with this invention.
Figure 2:
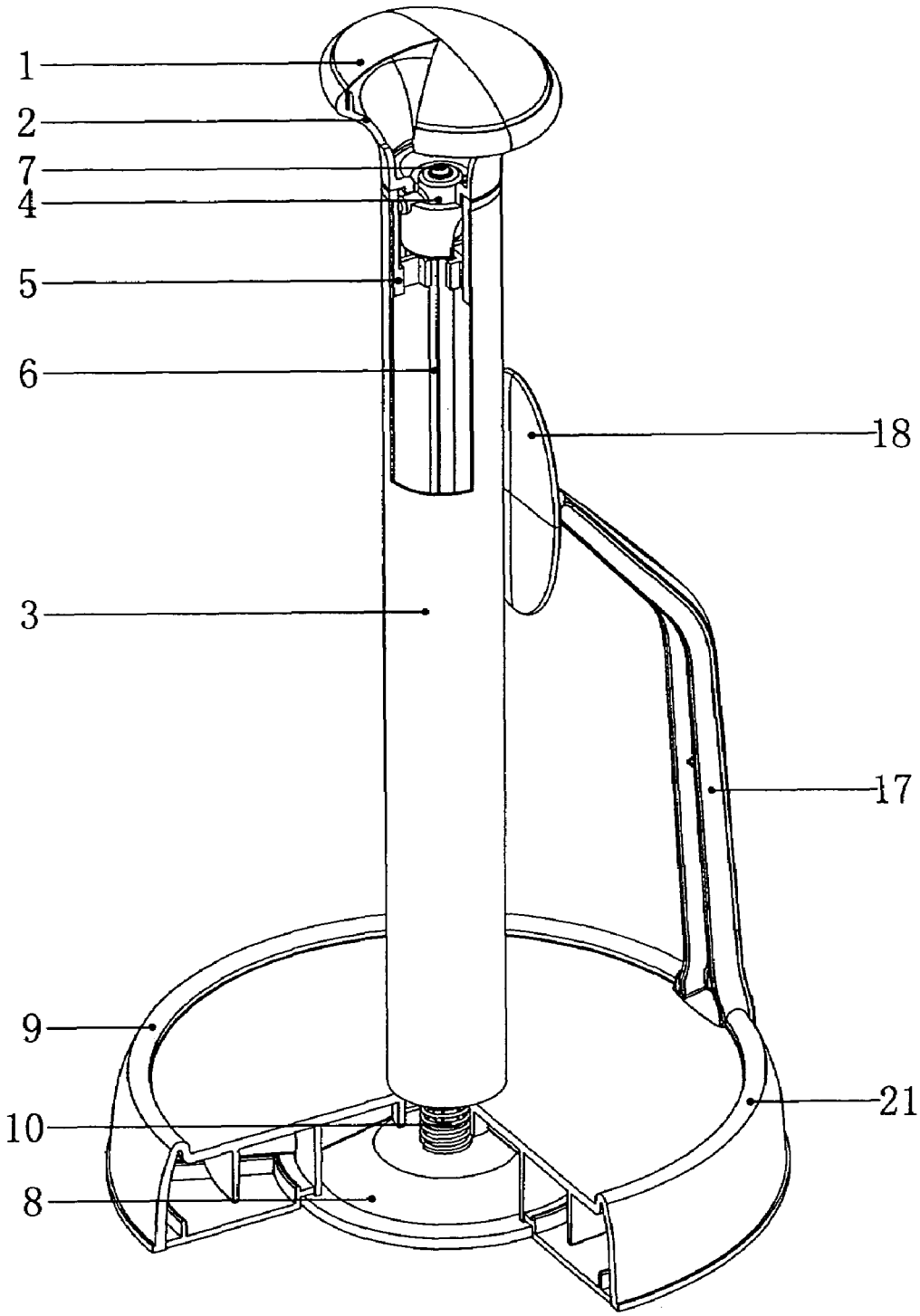
FIG. 2 is a partially cut away view of the holder.
Figure 3:
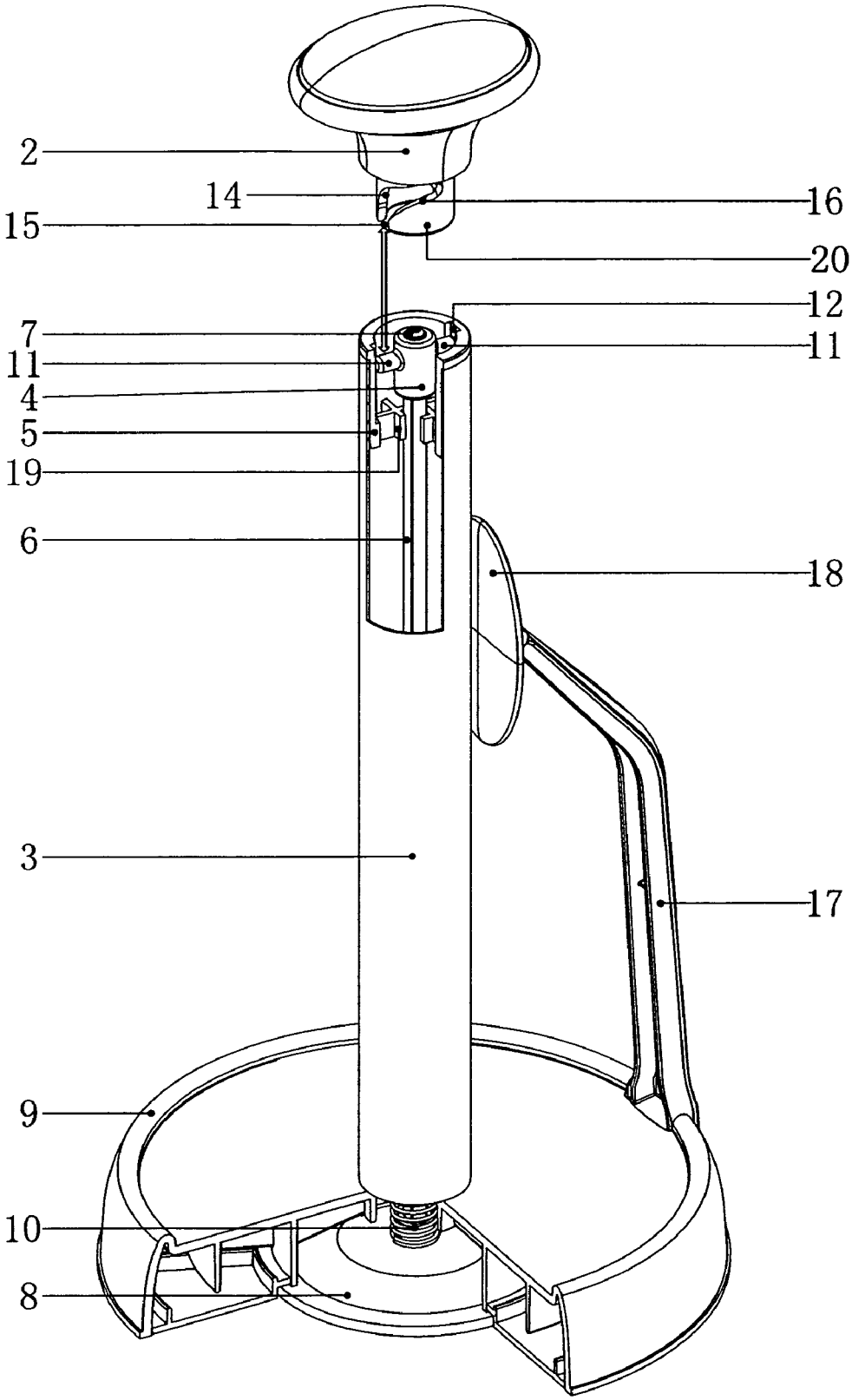
FIG. 3 is a partially cut away view with the handle removed.
Figure 4:
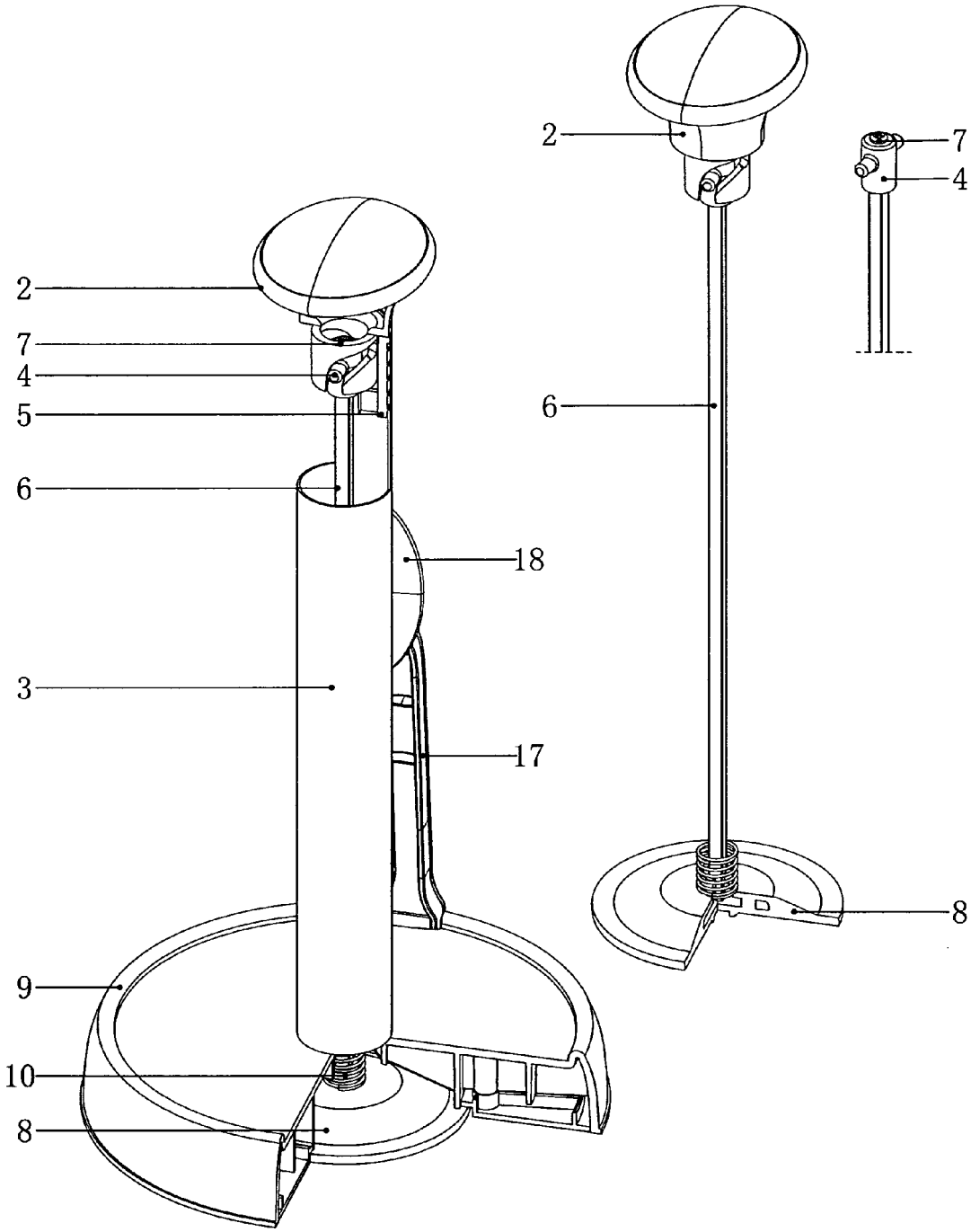
FIG. 4 is a partially cut away view with a handle inserted.
Figure 5:
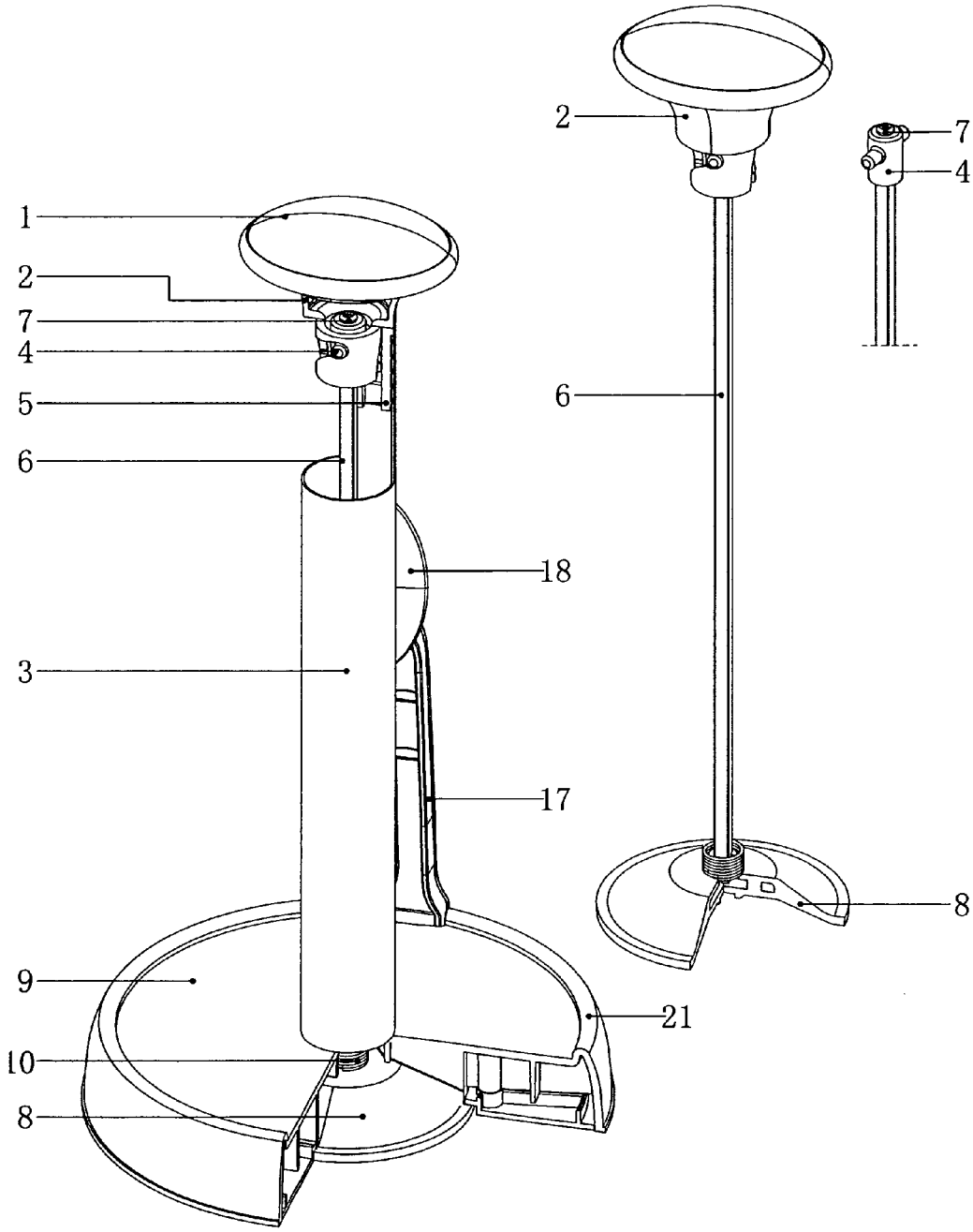
FIG. 5 is a partially cut away view with the handle rotated.

In the accompanying drawings the same reference numerals are used to denote the like components in each drawing.

The towel roll holder shown in the drawings comprises a base (9) having a suction cap (10) adapted to engage a supporting surface, for example a kitchen work surface (not shown). A mandrel (3) extends axially vertically from the base (9). A handle comprising an upper portion (1) and lower portion (2) is mounted upon the mandrel.

Rotation of the handle causes raising or lowering of the central portion of the suction cup to generate or release a movement-resisting suction force between the towel holder and the underlying work surface.

A rigid elongate rod (6) extends from an attachment at the central portion of the suction cup (8). A T-shaped connector (4) is secured to the upper part of the rod (6) by means of a screw (7). Two diametrically opposed radially extending projections or lugs extend outwardly from the T-shaped connector and are received in slots (12) within a guide member (5). The guide member (5) is cylindrical and dimensioned to fit snugly within the tubular mandrel (3). Ribs or other formations on the outer surface of the guide member allow secure engagement of the guide member within the mandrel (3). The guide member may also include a square or rectangular shaped formation (19) adapted to receive a correspondingly shaped rod (6) preventing rotation of the latter but allowing sliding movement actually of the mandrel. In this way the T-shaped connector and projections thereof are constrained to slide in an axial, vertical direction within the guide member (5). The handle has a generally cylindrical downwardly extending collar or skirt (20) having a diameter suitable to snugly fit within the sleeve (5) permitting rotation of the handle. The collar or skirt (20) has a plurality of slots, or preferably two slots with each slot having a downwardly opening mouth (15), and inclined or sinusoidal portion (14) and an upper rebate or seat adapted to receive and engage the projections (11) in the uppermost position.

The handle may be removed from the mandrel to permit replacement of the towel roll.

Rotation of the handle in a clockwise direction raises the projections (11), within the slots (12) causing raising of the rod (6) and corresponding raising of the central portion of the suction cap (8) to create a suction force. Rotation in the opposite direction lowers the cup releasing the force.

The outer portion of the base (9) includes a lip (21) to receive the outer edge of a roll (not shown). An arm (17) extends upwardly from the outer portion or lip and carries a pad (18). The arm may be connected to the base and to the pad by means of hinges or resiliently flexible moulded portions. The upper part of the arm is inclined inwardly towards the mandrel. The radially inwardly facing surface of the pad (18) may be coated with a friction creating material, for example a rubberised material. In use the arm may be resiliently bent or deflected outwardly to allow a roll to be inserted, the arm (17) exerting an inwardly directed force preventing free movement of the roll in order to facilitate tearing of a sheet or a plurality of sheets from the roll by a user.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A paper towel holder comprising a base and a mandrel extending upwardly from the base, the base including a suction cup arranged to engage a support surface in use, an actuator mechanism adapted to raise or lower the centre of the suction cup to create or release a movement resisting suction between the cup and the support surface, the mechanism comprising an elongate member connected to the cup and extending axially of the mandrel, an actuator including a hand grip mounted for rotational movement at the top of the mandrel, one or more radially extending projections at the top of the elongate member, the actuator including a collar comprising one or more of cam surfaces, the or each cam surface being arranged to engage the or each projection to raise or lower the said projection as the actuator is rotated, a sleeve including one or more vertical guide channels, each channel being adapted to receive a projection to prevent rotation of the projection during use.

2. The paper towel holder as claimed in claim 1 wherein the elongate member comprises an inextensible member.

3. The paper towel holder as claimed in claim 2 wherein the elongate member comprises a rod.

4. The paper towel holder as claimed in claim 3 wherein the elongate member comprises a rod which is rectangular or square in cross section.

5. The paper towel holder as claimed in claim 1, comprising a spring located between the cup and base.

6. The paper towel holder as claimed in claim 1, wherein the sleeve is cylindrical and adapted to be located within the mandrel.

7. The paper towel holder as claimed in claim 6 wherein the exterior of the sleeve is ribbed.

8. The paper towel holder as claimed in claim 1, wherein the sleeve includes a rectangular or square collar.

9. The paper towel holder as claimed in claim 1, wherein the actuator comprises a hand grip and downwardly extending cylindrical collar.

10. The paper towel holder as claimed in claim 9 wherein the collar is rotatable within the sleeve.

11. The paper towel holder as claimed in claim 9 comprising two radially extending projections the collar having two corresponding slots adapted to receive the projections.

12. The paper towel holder as claimed in claim 11 wherein each slot has a downwardly extending mouth and a sinusoidal or inclined portion so that the projections are raised as the handle is rotated.

13. The paper towel holder as claimed in claim 11, wherein the upper end of each slot has a downwardly extending end portion or rebate.

14. The paper towel holder as claimed in claim 1, wherein the hand grip is removable to permit replacement of a roll.

* * * * *